US007096695B2

(12) United States Patent
No et al.

(10) Patent No.: US 7,096,695 B2
(45) Date of Patent: Aug. 29, 2006

(54) WASHING MACHINE

(75) Inventors: Yang Hwan No, Changwon-shi (KR); Han Ki Cho, Changwon-shi (KR); Myeong Seok Park, Chinbac-shi (KR); Young Hoon Ha, Masan-shi (KR); Jong Seok Kim, Changwon-shi (KR); Jeong Hoon Kang, Taegu-kwangyokshi (KR); Youn Su Jung, Changwon-shi (KR)

(73) Assignee: LG Electronics Inc., Seoul (KR)

( * ) Notice: Subject to any disclaimer, the term of this patent is extended or adjusted under 35 U.S.C. 154(b) by 561 days.

(21) Appl. No.: 10/272,910

(22) Filed: Oct. 18, 2002

(65) Prior Publication Data

US 2003/0074932 A1 Apr. 24, 2003

(30) Foreign Application Priority Data

| | | |
|---|---|---|
| Oct. 23, 2001 | (KR) | P 2001-65458 |
| Oct. 23, 2001 | (KR) | P 2001-65459 |
| Jan. 9, 2002 | (KR) | P 2002-1292 |
| Jan. 9, 2002 | (KR) | P 2002-1293 |

(51) Int. Cl.
*D06F 37/00* (2006.01)
*D06F 37/06* (2006.01)

(52) U.S. Cl. ..... 68/58; 68/142; 366/228

(58) Field of Classification Search ..... 68/24, 68/58, 142; 366/220, 228, 232, 234
See application file for complete search history.

(56) References Cited

U.S. PATENT DOCUMENTS

| | | | | |
|---|---|---|---|---|
| 408,797 | A * | 8/1889 | Cronk | 68/173 |
| 1,389,182 | A | 8/1921 | Binder | |
| 2,480,929 | A * | 9/1949 | Hyman | 34/108 |
| 3,922,890 | A | 12/1975 | Shibata | |
| 4,971,449 | A * | 11/1990 | Hendren | 366/228 |

FOREIGN PATENT DOCUMENTS

| | | |
|---|---|---|
| DE | 537 758 | 11/1931 |
| DE | 297 17 594 U1 | 1/1998 |
| JP | 47-099700 | 5/1974 |
| JP | 50-172386 | 6/1977 |
| JP | 53-164686 | 6/1980 |
| JP | 08-309073 | 11/1996 |
| JP | 09-215894 | 8/1997 |

* cited by examiner

*Primary Examiner*—Joseph L. Perrin
(74) *Attorney, Agent, or Firm*—McKenna Long & Aldridge LLP

(57) ABSTRACT

Washing machines having improved frictional forces with laundry. Those machines include a cabinet with a door, a tub inside for retaining wash water, and an internal vessel, inside the tub that is coupled with a motor that rotates the internal vessel. A friction member inside the internal vessel rubs against laundry. The frictional member includes a friction enhancer, such as a spherical structure or a freely rotating ball, that enhances laundry friction during washing and reduces adhesion of laundry after a dehydration cycle.

40 Claims, 15 Drawing Sheets

WASHING MACHINE

This application claims the benefit of Korean Patent Applications P2001-65458 and P2001-65459, which were filed on Oct. 23, 2001, and which are hereby incorporated by reference.

BACKGROUND OF THE INVENTION

1. Field of the Invention

This invention relates to washing machines. More particularly, it relates to washing machines having improved washing performance and easier laundry removal.

2. Discussion of the Related Art

Washing machines operate by revolving a vessel that holds laundry, water, and detergent such that friction, water current, and chemical action clean the laundry. While there are various types of washing machines, common types include drum type washing machines and pulsator type washing machines.

The structure of a typical drum washing machine is schematically illustrated in FIG. 1. As shown, a drum washing machine includes a cabinet 1 having a front door 2, a tub 3 inside the cabinet 1 that retains wash water, and a rotating drum 4 inside the tub 3 that retains laundry. A motor 5 behind the tub 3 is coupled by a driving shaft 6 to the drum 4. Also, a suspension system 7 retains the tub 3 within the cabinet 1 such that the position of the tub 3 can fluctuate slightly.

Still referring to FIG. 1, the driving shaft 6 is coupled to the drum 4 by a spider 8 (which can be tripod-shaped). Additionally, as shown, a number of lifters 10 are mounted on a wall of the drum 4. When the motor 5 rotates the drum 4, the lifters 10 also rotate. Laundry is lifted upward by the lifters 10 until the laundry freely falls down. Continuous rotation causes the laundry to continuously move up and down. Such laundry movement produces a good laundry cleaning action.

FIG. 2 illustrates a typical lifter 10 in more detail. The lifter 10 includes a pair of protrusions 11 that have different heights and that are separated by a valley 12. Coupling hooks 13 at the bottom of the lifter 10 can couple the lifter 10 to the drum 4.

While generally successful, the lifters 10 do not provide optimal washing performance. One reason for this is that the lifters 10 generally have flat (or at least smooth) surfaces that fail to maximize laundry friction. Thus, friction-induced cleaning is limited. Such limited cleaning action occurs not only in drum type washing machines, but also in pulsator type washing machines. The pulsator type cleans both by water flow and by laundry friction. Yet, the widely used pulsator type washing machine also uses generally flat (or at least smooth) contact surfaces. Again, this limits the attainable cleaning action.

While generally successful when cleaning laundry, the lifters 10 become obstacles when removing laundry. Centrifugal forces exerted during a dehydration cycle forces laundry against the wall of the drum 4 and into the valley 12. This causes the laundry to adhere to the drum 4 such that the laundry can be difficult to remove.

A modification to the standard drum type washing machine is the slant-drum washing machine. In such a machine the drum 4 is tilted downward. This reduces the difficulty of inserting and removing laundry. However, in slant-drum 4 washing machines the laundry tends to gather toward the rear of the drum 4 such that the lifters 10 fail to smoothly move the laundry. Thus, cleaning performance is reduced.

Therefore, washing machines having improved washing performance obtained by increasing the friction of lifters with laundry would be beneficial. Also beneficial would be a washing machine having easy laundry removal after dehydration cycles. Also beneficial would be a slant-drum washing machine having a reduced tendency for laundry to congregate at the back of the drum. Even more beneficial would be a drum washing machine with improved laundry friction and ease of laundry removal.

SUMMARY OF THE INVENTION

Accordingly, the present invention is directed to a washing machine that substantially obviates one or more problems due to limitations and disadvantages of the related art.

An object of the present invention is to provide a washing machine with improved washing performance caused by increased laundry friction.

Another object of the present invention is to provide a washing machine enabling easy laundry removal after dehydration.

Another object of the present invention is to provide a slant-drum washing machine having a reduced tendency to congregate laundry at the rear of the drum.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a washing machine according to the present invention includes a cabinet having a door and a rotatable internal vessel inside the cabinet for retaining laundry. The internal vessel, which is coupled with a motor, can be located within a water-retaining vessel. A friction member inside the internal vessel generates water current when the internal vessel is rotated. A friction enhancer, which is part of the friction member, increases the friction between the friction member and the laundry.

Preferably, the friction member is a lifter, when the washing machine is a drum or a slant-drum type washing machine, or a pulsator when the washing machine is a pulsator type washing machine.

Preferably, the friction enhancer includes washing protrusions or washing balls that protrude from the friction member toward the middle of the internal vessel.

In another aspect of the present invention, a washing machine includes a cabinet having a front door, a tub inside the cabinet that retains wash water and that includes an opening that confronts the door. A drum, located inside the tub, is coupled with a driving part (such as by a shaft) that rotates the drum. Lifters inside the drum protrude toward the center of the drum. As the drum rotates, the lifters move the laundry upward until the laundry freely falls downward. Friction between the laundry and the lifters help clean the laundry. The lifters include friction enhancers, such as protrusions or washing balls, that increase the friction between the lifters and the laundry, thus improving cleaning. Additionally, the friction enhancers reduce adhesion between the laundry and the drum/lifters after a dehydration cycle, which makes the laundry easier to remove.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE ILLUSTRATED EMBODIMENTS

Reference will now be made in detail to preferred embodiments of the present invention, examples of which are illustrated in the accompanying drawings. Wherever possible, the same reference numbers will be used throughout the drawings to refer to the same or like parts.

A washing machine according to the present invention includes a cabinet having a door, a water storage vessel (tub) inside the cabinet for retaining water, and a rotating laundry vessel (drum) inside the water storage vessel for holding laundry. The laundry vessel is coupled to a driving part (motor) that rotates the laundry vessel. The washing machine further includes a friction member inside the laundry vessel that produces water current and that contacts (rubs) laundry in the laundry vessel so as to induce cleaning. The friction member includes a friction enhancer that increases laundry friction.

The friction enhancer can include washing protrusions that protrude inward from the friction member. Alternatively, the friction enhancer can include washing balls that protrude inward. In any event, the friction enhancers increase cleaning friction with the laundry. Additionally, the friction enhancers reduce the difficulty of removing laundry from the washing machine.

Beneficially, the friction member is either a pulsator or a lifter, depending on the type of washing machine. Namely, a pulsator type washing machine uses a pulsator, while a drum type washing machine uses a lifter.

Various embodiments that incorporate the principles of the present invention are described below.

FIRST EMBODIMENT

Figure 3:
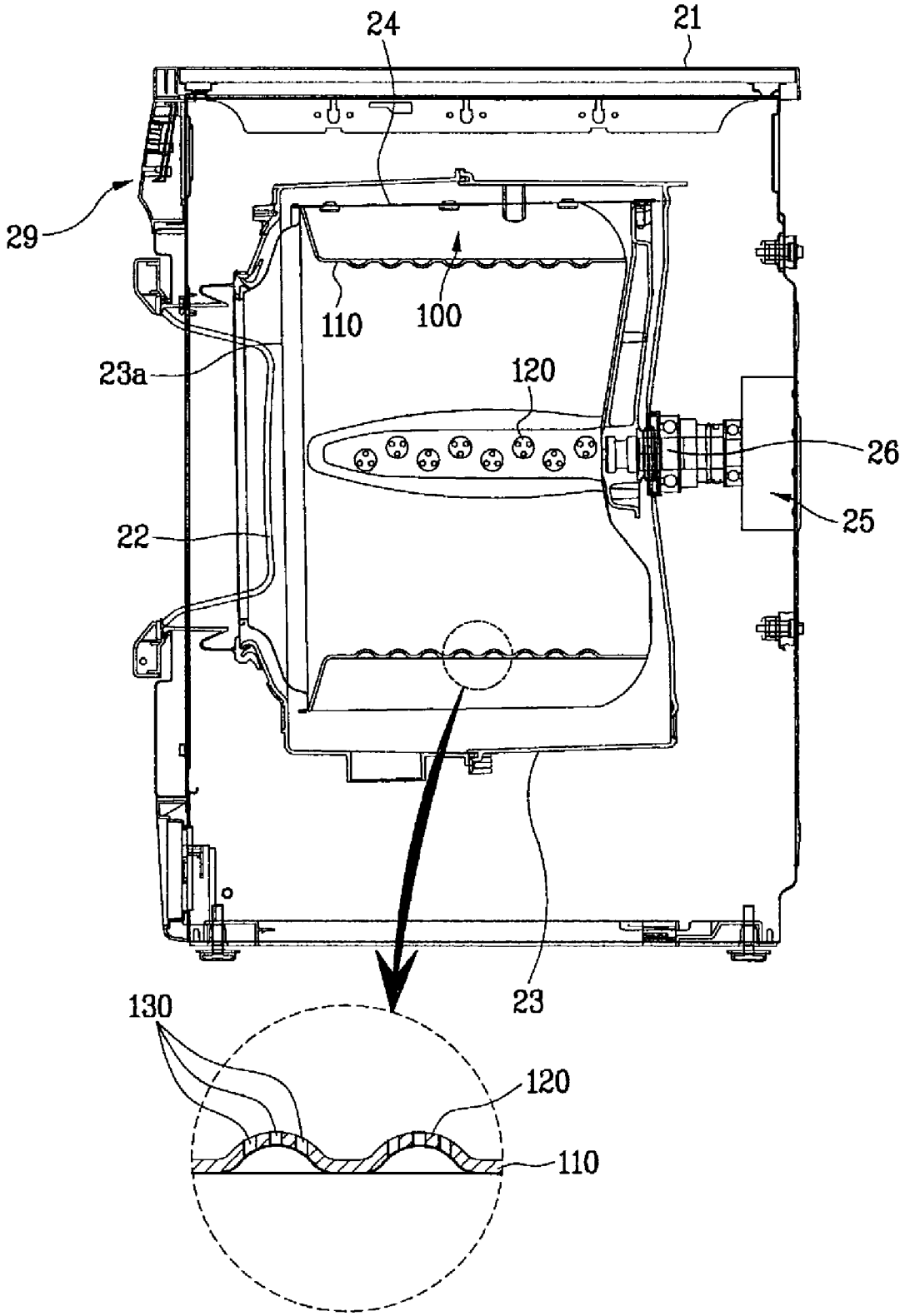
FIG. 3 illustrates a cross-sectional view of a drum type washing machine according to a first embodiment of the present invention, including a magnified cross-sectional view of a portion of a lifter.

FIG. 3 illustrates a sectional view of a drum type washing machine according to a first embodiment of the present invention. FIG. 3 includes a magnified sectional view of a portion of a lifter. A washing machine according to a first embodiment includes a cabinet 21 having a front door 22, and a tub 23 inside the cabinet 21 that includes an opening 23*a* that confronts the door 22. Inside the tub 23 is a rotating drum 24. The tub 23 retains wash water, while the drum 24 retains laundry. A driving part 25 (motor) behind the tub 23 is coupled to the drum 24 by a driving shaft 26. The driving part 25 (motor) induces a rotational force that turns the drum 24. In the first embodiment, the drum 24 is parallel with the tub 23, which, in turn, is parallel with the ground.

On the wall of the drum 24 are a number of inwardly protruding lifters 100 that are elongated along the rotational axis of the drum 24. The heights of all of the lifters 100 are beneficially the same.

Still referring to FIG. 3, each lifter 100 includes a plurality of washing protrusions 120 that protrude into the drum 24 from protruding faces 110. The washing protrusions 120 increase the contact area of the lifter 100 with the laundry, and thus act as friction enhancers. The washing protrusions 120 may be integral features of the lifters 100, or they may be discrete elements that are coupled with the protruding faces 110.

The washing protrusions 120 are beneficially hemispherical. This reduces laundry damage while increasing laundry friction. The washing protrusions 120 also reduce adhesion between the laundry and the lifters 100 following a dehydration cycle. This is because the centrifugal forces that push the laundry against the drum wall during the dehydration cycle will seldom be sufficient to eliminate all spaces between the lifters 100 and the laundry. Such spaces significantly reduce the adherence of the laundry to the lifters 100, making the laundry easier to remove.

However, the washing protrusions 120 do not have to be hemispherical. Other shapes can increase the laundry contact area while leaving spaces between the lifters 100 and the laundry.

Still referring to FIG. 3, to improve washing the lifters 100 include a number of drain holes 130. For instance, in FIG. 3 the drains holes 130 are formed through the washing protrusions 120. The drain holes 130 enable wash water to flow between the lifters 100 and the drum 24. Wash water that has flowed through the drain holes 130 to the lifters 100 is free to fall as the lifters 100 rotate. The falling wash water soaks and impacts the laundry, thus improve washing.

The operation of the first embodiment washing machine is as follows. First, a user selects a proper washing sequence through a control panel 29. With laundry and soap in the drum 24, the drum 24 is supplied with wash water through a supply pipe. After the correct amount of water is added, electric power is applied to the driving part 25 (motor), which then turns the drum 24. As the drum 24 rotates, the lifters 100 lift the wash water and laundry until they fall free. Significantly, the washing protrusions 120 increase the frictional forces against the laundry. Additionally, wash water flows into the lifters 100 as they dip into the wash water. As the lifters 100 rotate upward the wash water in the lifters drops through the drain holes 130, impacting on the laundry, and improving performance. The process is vigorously repeated to rub the laundry, thereby carrying out cleaning. Subsequently, rinsing and dehydration cycles are performed. Water falling from the drain holes 130 also improves rinsing during the rinsing cycles.

SECOND EMBODIMENT

Figure 4:
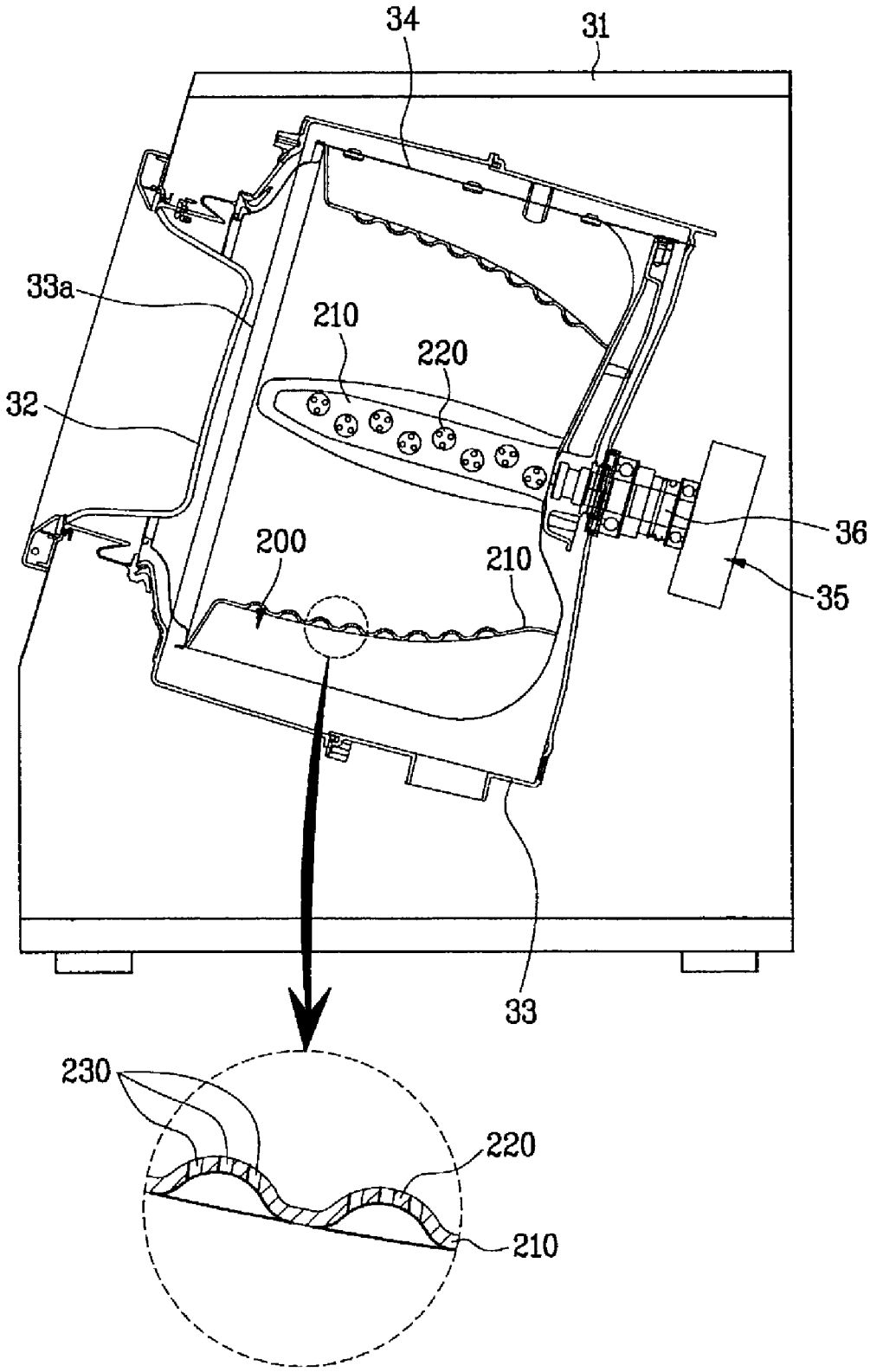
FIG. 4 illustrates a cross-sectional view of a slant type washing machine according to a second embodiment of the present invention, including a magnified cross-sectional view of a portion of a lifter.

FIG. 4 illustrates a sectional view of a slant type washing machine according to a second embodiment of the present invention. FIG. 4 also includes a magnified view of a portion of a lifter. Referring now to FIG. 4, a washing machine according to the second embodiment is a slant-drum type washing machine. That machine includes a cabinet 31 having a door 22 at a slanted face. A tub 33 inside the cabinet retains wash water. The tub 33 includes an opening 33*a* that confronts the door 32. Inside the tub 33 is a drum 34. A driving part 35 (motor) located behind the tub 33 is coupled to the drum 34 by a driving shaft 36. The tub 33 is installed at an incline such that the front of the tub 33 (having the opening 33*a*) is higher than the rear.

Still referring to FIG. 4, a number of lifters 200 are installed on a wall of the drum 34. Those lifters 200, which inwardly protrude toward the rotational axis of the drum 34, are elongated along the rotational axis. The lifters 200 each have washing protrusions 220 on protruding faces 210. Beneficially, the washing protrusions 220 are hemispherical. Furthermore, the lifters 200 each include a number of drain holes 230 through the washing protrusions 220.

The functions of the washing protrusions 220 and drain holes 230 are the same as described with reference to the first embodiment. Therefore, the second embodiment enables improved washing by providing increased friction between the washing protrusions 220 and the laundry, and by providing free falling wash water through the drain holes 230. As also described above, the washing protrusions (220) reduce adhesion between the laundry and the lifters 200, thereby enabling easy removal of laundry from the washing machine.

As shown in FIG. 4, the height of the lifters 200 increases from the front of the drum 34 to the rear. This compensates for the inclination of the tub 33 and the drum 34 so that the protruding faces 210 of the lifters 200 are more parallel with the ground. This reduces the tendency for laundry to concentrate at the rear of the drum 34. Furthermore, even if laundry does concentrate at the rear, the shape of the lifters 200 tends to move the laundry forward. Thus, the lifters 200 act to distribute the laundry evenly in the drum 34. This also tends to improve washing performance.

THIRD EMBODIMENT

Figure 5:
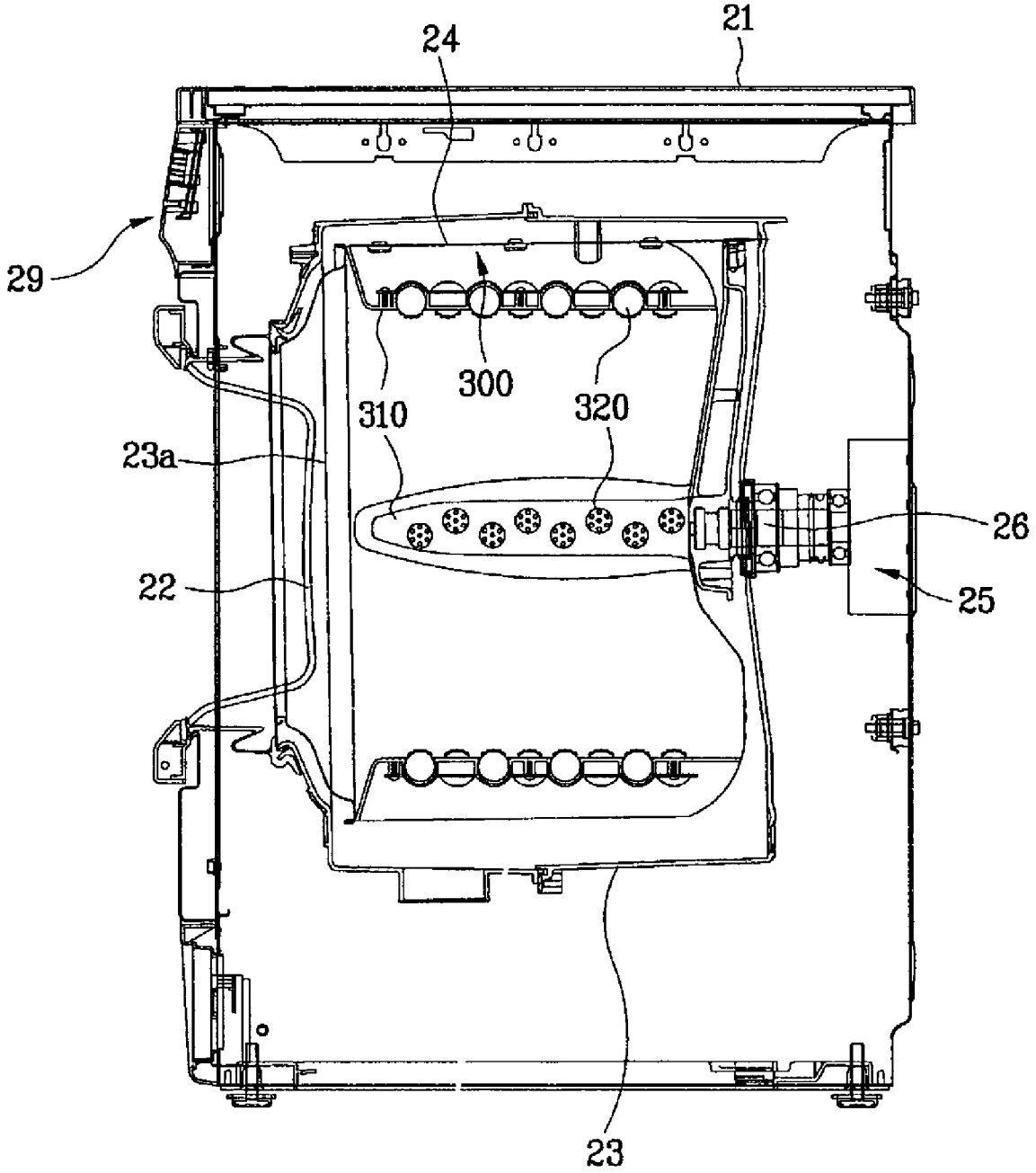
FIG. 5 illustrates a cross-sectional view of a drum type washing machine according to a third embodiment of the present invention.

FIG. 5 illustrates a cross-sectional view of a drum type washing machine according to a third embodiment of the present invention. As the third embodiment drum type washing machine is very similar to the first embodiment washing machine, the following is specifically directed at the lifters 300 (which are different).

As shown in FIG. 5, a number of lifters 300 are installed on the wall of the drum 24. Those lifters 300 each beneficially extend parallel to the axis of the drum 24 and protrude from the drum wall toward the center of the drum 24. Each lifter 300 includes a number of washing balls 320 that protrude from faces of the lifters 300. The washing balls 320 act as friction enhancing devices. The washing balls 320 rotate in the lifters 300 by the friction with the laundry.

Figure 6:
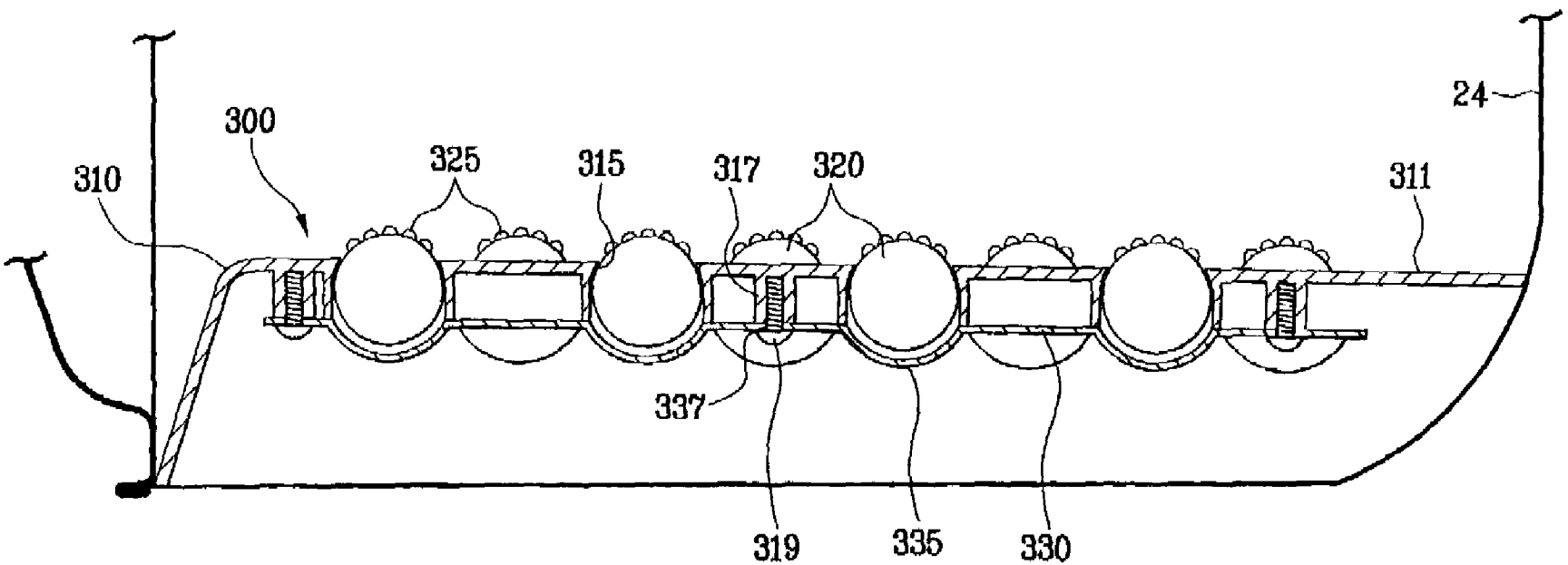
FIG. 6 illustrates a cross-sectional view of a lifter used in the drum type washing machine in FIG. 5.

FIG. 6 illustrates a cross-sectional view of a lifter 300. As shown, each lifter 300 includes a lifter body 310 that is coupled to the wall of the drum 24. A ball support structure 330 is installed inside the lifter body 310. The ball support structure 330 supports, retains, and separates the washing balls 320 such that they are free to rotate in ball sockets 315. The ball sockets 315 are formed such that a portion of each washing ball 320 extends from the lifter body 310. In practice the diameter of the washing balls 320 should be such that they do not fall into the drum 24 or lifter 300.

The ball support structure 330 takes the form of a plate-like support cover that is coupled with the rear of a protruding face 311 of the lifter body 310. A plurality of locking bosses 317 is formed at the protruding face 311. A plurality of locking grooves 337 is formed at a support cover 330 in positions that correspond to the locking bosses 317. Therefore, the support cover 330 can be coupled with the lifter body 310 by locking bolts 319.

Additionally, a plurality of support grooves 335 are formed in the support cover 330 at positions that correspond to the washing ball sockets 315 so as to enable the washing balls 320 to rotate. Each of the support grooves 335 is beneficially concave so as to correspond to the curvature of the washing balls 320.

Also, a plurality of auxiliary protrusions 325 can be formed on the washing balls 320. The auxiliary protrusions 325 induce greater friction with the laundry. This enables improved washing performance. The auxiliary protrusions 325 are preferably formed so as to define the angle through which the washing balls 320 can rotate.

The operation of the third embodiment will be briefly explained. First, the lifters 300 move laundry as the drum 24 rotates during washing and rinsing cycles. During this process, the washing balls 320 rotate in the washing ball sockets 315 and the support groves 335 due to laundry friction. The washing balls 320 increase the friction area between the lifters 300 and the laundry, producing vigorous cleaning. If present, the auxiliary protrusions 325 increase laundry friction even more, thereby improving laundry performance.

Additionally, centrifugal forces produced by the rotation of the drum 24 during a dehydration cycle cause the laundry to be forced toward the wall of the drum 24 and the lifters 300. The washing balls 320 induce gaps between the lifter body 310 and the laundry, thereby reducing the difficulty of removing the laundry from the washing machine. Furthermore, since the washing balls 320 can rotate, separating the laundry from the lifters 300 is even easier.

Furthermore, if present, the auxiliary protrusions 325 further reduce adhesion between the laundry and the lifters 300. Therefore, after dehydration, the laundry is withdrawn with less difficulty.

FOURTH EMBODIMENT

Figure 7:
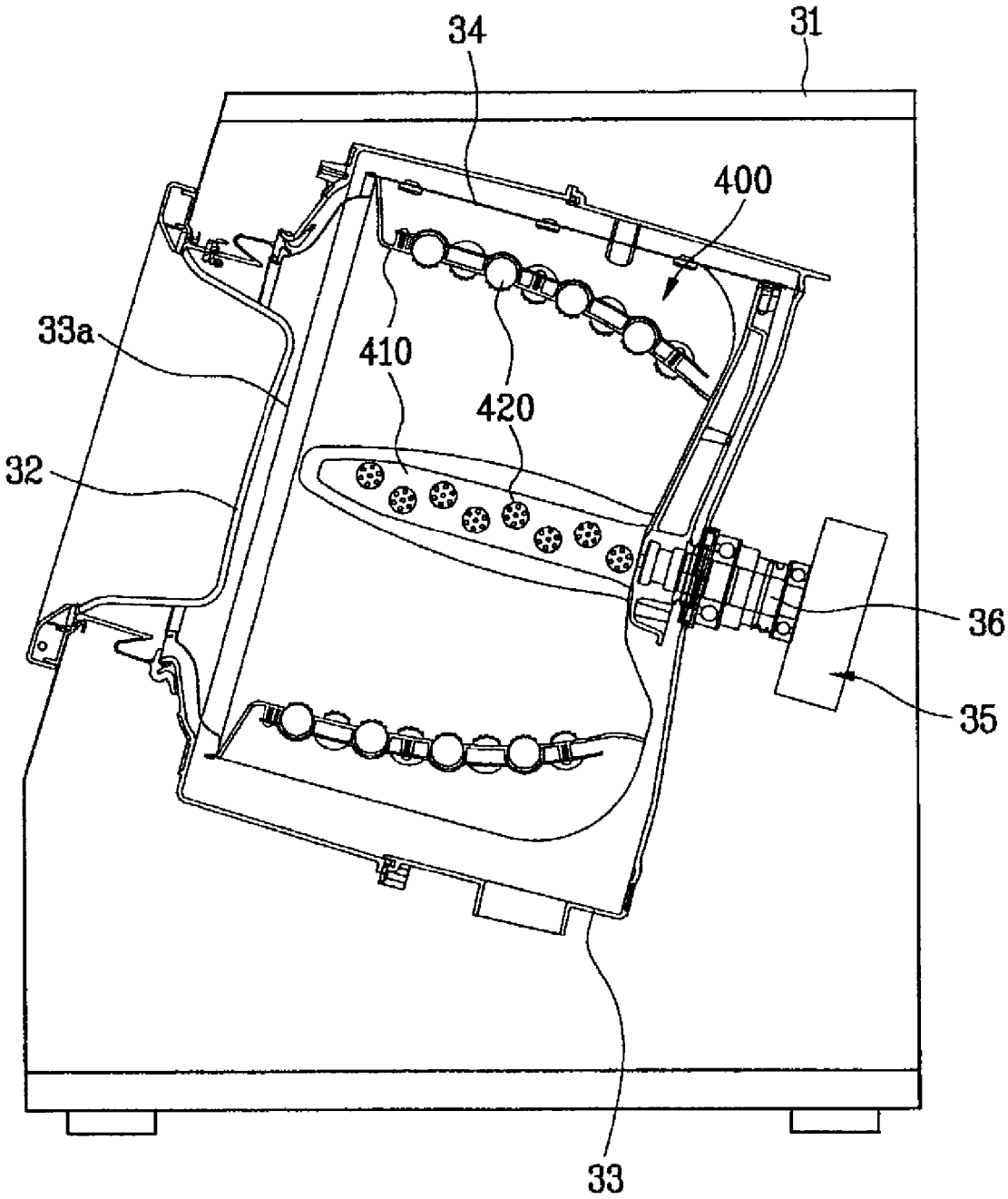
FIG. 7 illustrates a cross-sectional view of a slant-drum type washing machine according to a fourth embodiment of the present invention.

FIG. 7 illustrates a cross-sectional view of a slant-drum washing machine according to a fourth embodiment of the present invention. As the fourth embodiment is very similar to the second embodiment, only the lifters (which are different) are discussed in detail.

Referring to FIG. 7, a plurality of lifters 400 is installed on the wall of a slant drum 34. Those lifters 400 extend along the axis of rotation of the drum 34 and protrude toward the center of the drum 34. A plurality of washing balls 420 are installed at protruding faces of the lifters 400. The washing balls 420 are free to rotate when contacted by laundry. Each lifter 400 is formed to have a gradually increasing height as one proceeds from the front to the rear. This causes the protruding face of the lifter 400 to be substantially parallel to the ground.

Figure 8:
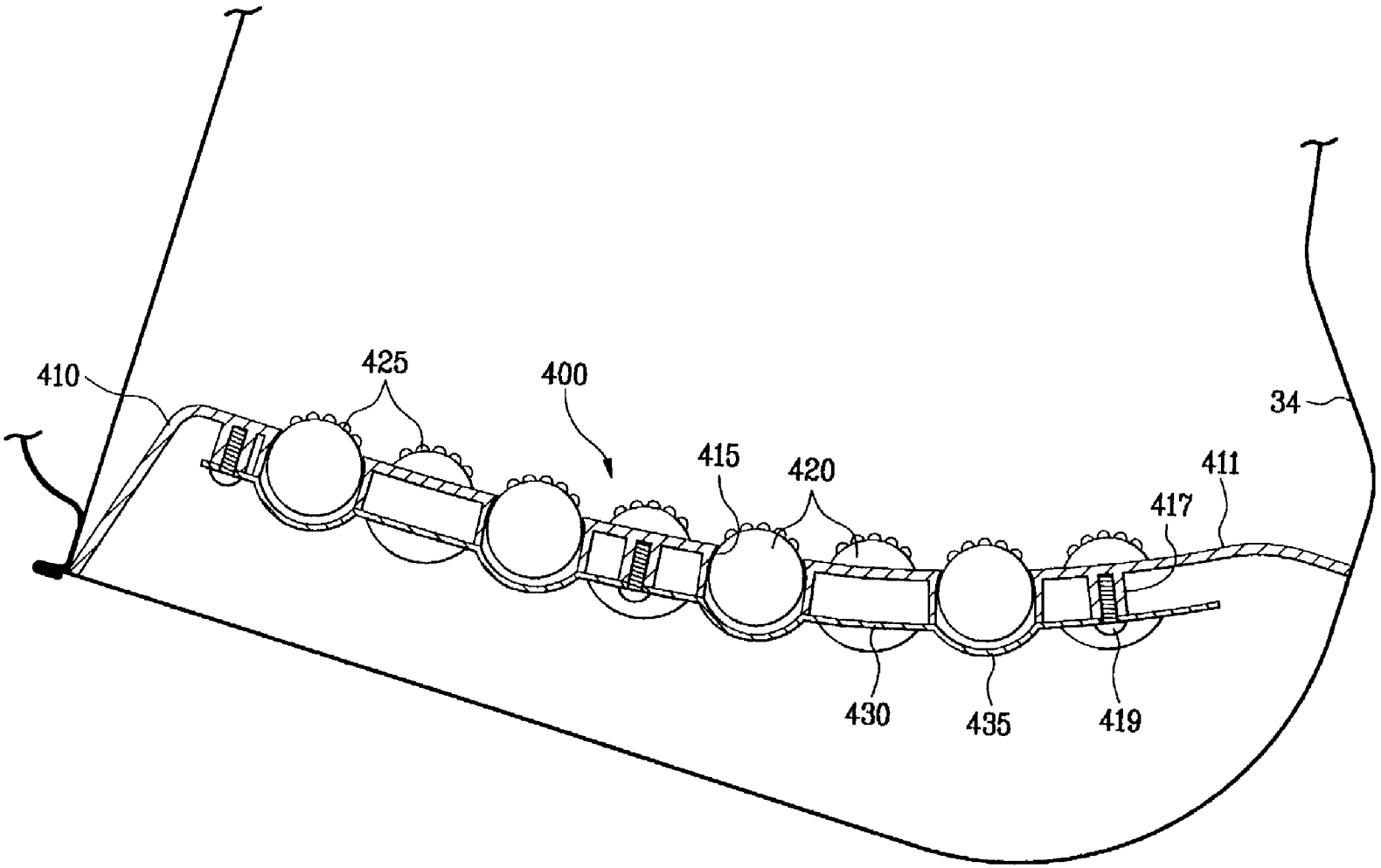
FIG. 8 illustrates a cross-sectional view of a lifter used in the slantdrum type washing machine in FIG. 7.

FIG. 8 illustrates a cross-sectional view of a lifter 400 used in the slant type washing machine of FIG. 7. That lifter is similar to that shown in FIG. 6.

Referring now to FIG. 8, each lifter 400 includes a lifter body 410 that is coupled with a wall of the drum 34, and a support cover 430 that is installed inside the lifter body 410 so as to support and retain the washing balls 420 such that they can rotate. A plurality of washing ball sockets 415 are formed at protruding faces 411 of the lifter body 410, and support grooves 435 are formed in the support cover 430 at positions that correspond to the washing ball sockets 415. A plurality of optional auxiliary protrusions 425 is formed on each washing ball 420. Furthermore, locking bosses 417 and locking bolts 419 are used to couple the support cover 430 with the lifter body 410.

Friction between the washing balls 420 and the laundry aids cleaning and laundry removal. Additionally, the auxiliary protrusions 425 further assist cleaning and laundry removal.

The protruding height of the lifter body 410 at the rear of the drum 34 is greater than at the front. Therefore, the lifters 400 reduce the tendency of the laundry to concentrate at the rear of the drum 34. Even if laundry does concentrate toward the rear, the lifters 400 reduce the difficulty of removing laundry.

FIFTH EMBODIMENT

Figure 9:
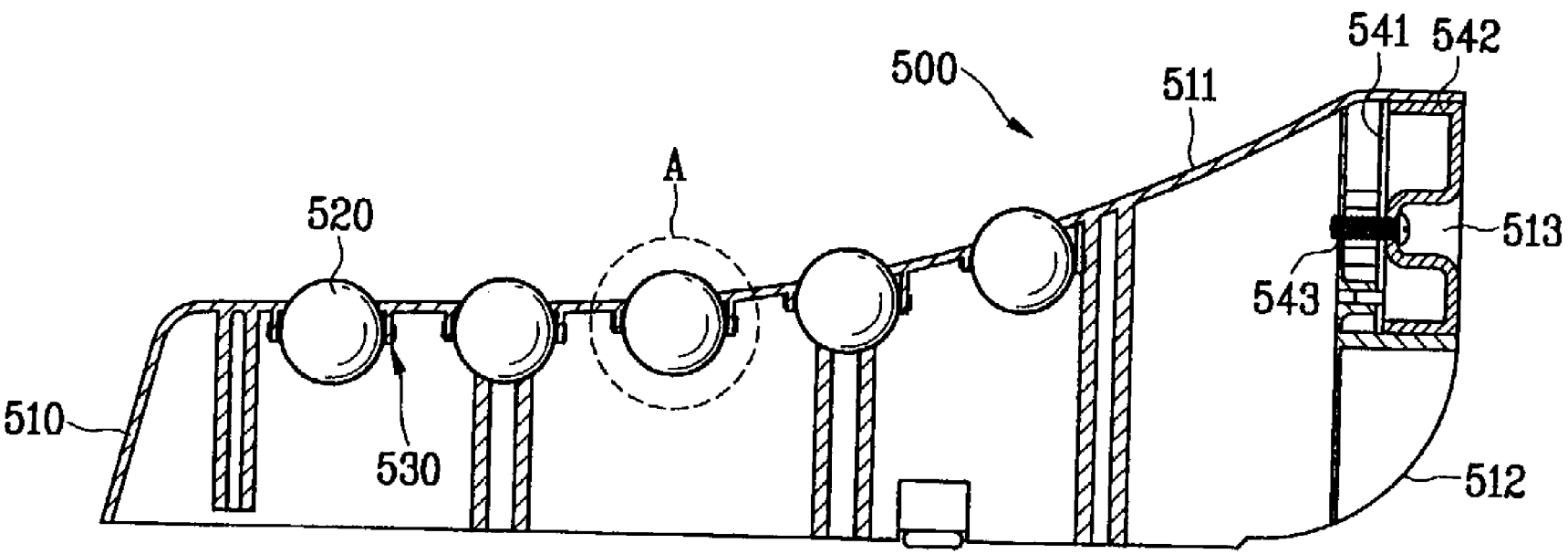
FIG. 9 illustrates a cross-sectional view of a lifter used in a drum type washing machine according to a fifth embodiment of the present invention.

FIG. 9 illustrates a cross-sectional view of a lifter 500 that is used in a drum type washing machine according to a fifth embodiment of the present invention. As the fifth embodiment is similar to the first embodiment (see FIG. 3), only the lifters 500 are discussed in detail.

Referring to FIG. 9, a plurality of washing balls 520 are installed at protruding faces 511 of each lifter 500. The washing balls 520 are rotatable and protrude from the lifter 500 so as to increase laundry friction.

Each lifter 500 is coupled with a wall of a drum and is elongated along the axis of rotation of the drum. Each lifter 500 includes a lifter body 510 that protrudes from the drum wall toward the center of the drum. A support means 530 inside the lifter body 510 supports the washing balls 520 such that the washing balls can rotate.

Figure 10:
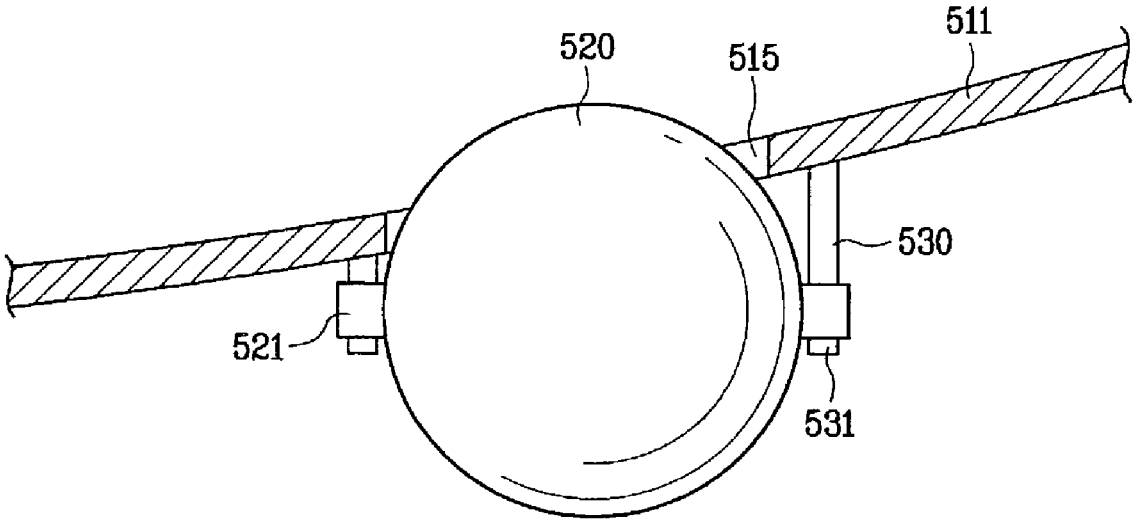
FIG. 10 illustrates a detailed diagram of part 'A' in FIG. 9.

FIG. 10 illustrates a detailed diagram of section 'A' illustrated in FIG. 9. As shown, a washing ball 520 passes through an insertion hole 515 in the protruding face 511 of the lifter body 510. A portion of the washing ball 520 is thus exposed in the drum. The diameter of the washing ball 520 is somewhat greater than the diameter of the insertion hole 515. The support protrusions 530 extend into the lifter body 510 near the insertion hole 515. Each washing ball 520 is beneficially shaft-coupled with support protrusions 530 that are installed around the washing balls 520 by a rotational shaft 521. Holding sills 531 are located at ends of the support protrusions 530 so as to retain the rotational shafts 521.

Figure 1:
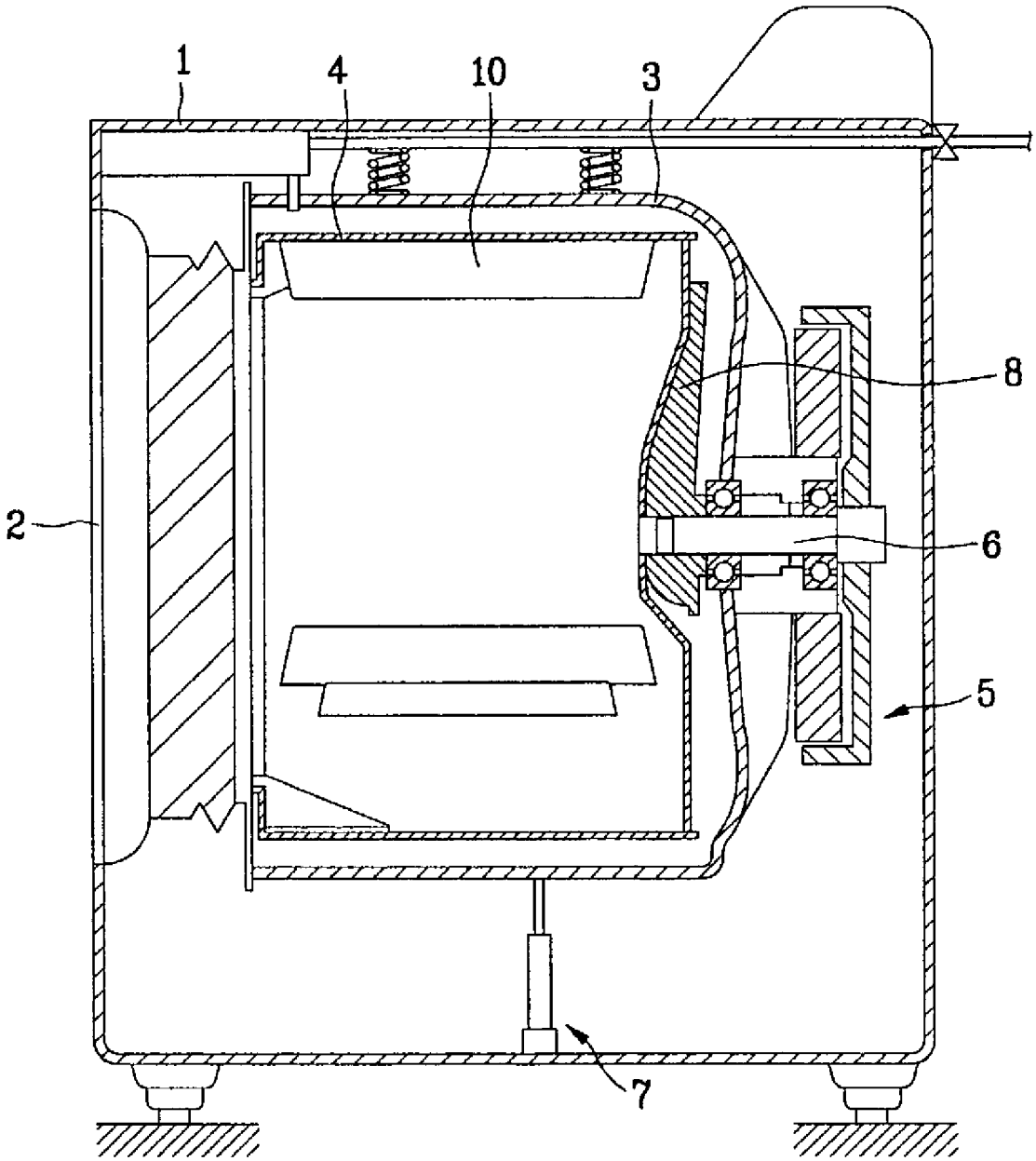
FIG. 1 illustrates a cross-sectional view of a typical drum type washing machine.
Figure 2:
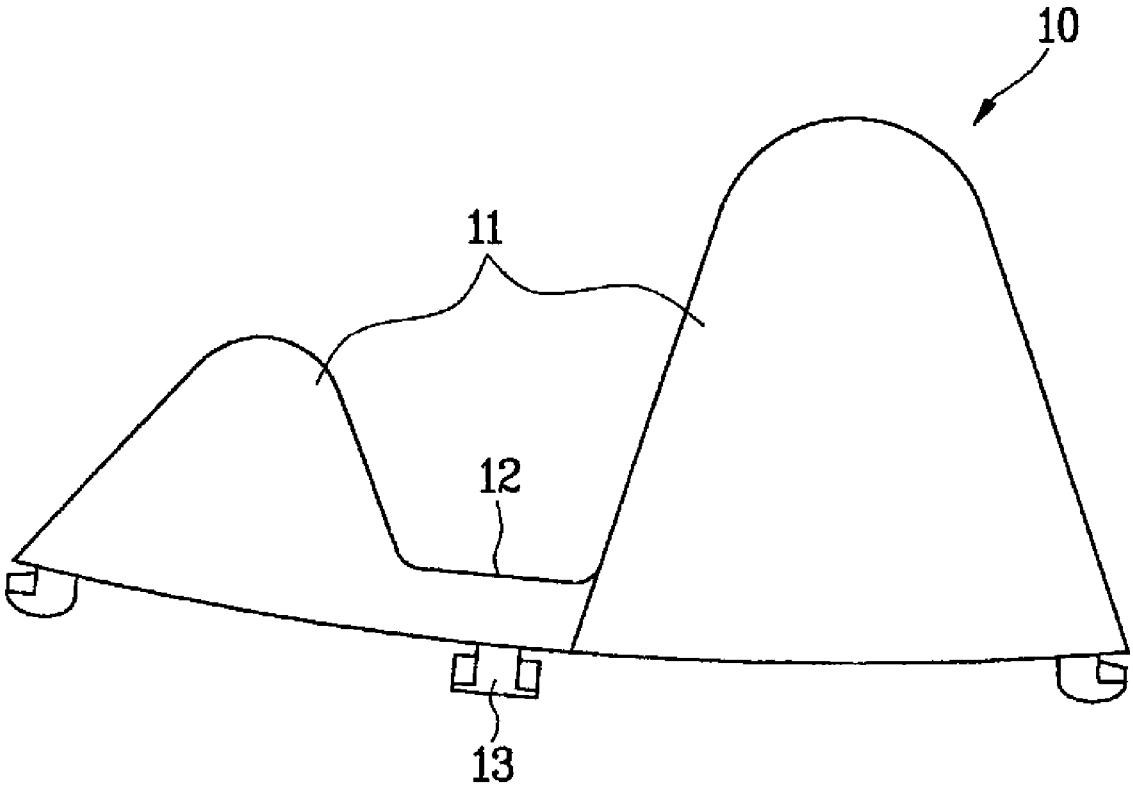
FIG. 2 illustrates a lifter used in the drum type washing machine of FIG. 1.
Figure 11:
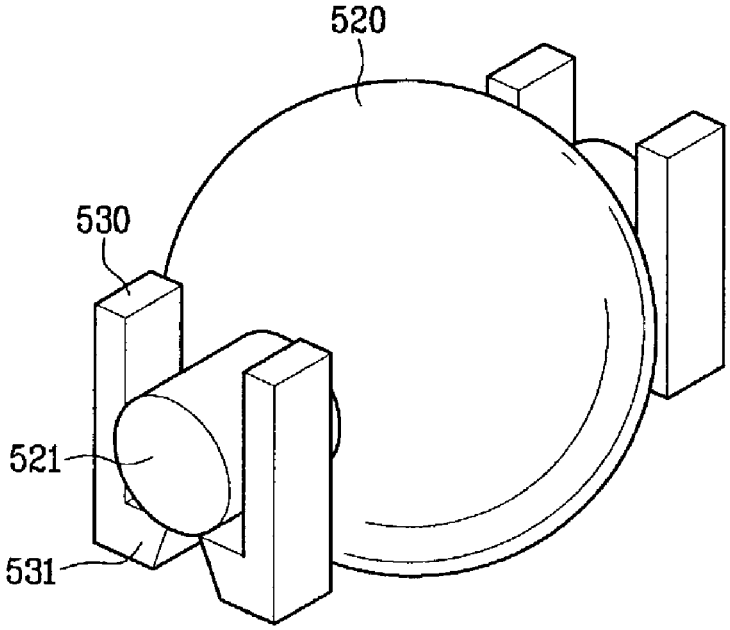
FIG. 11 illustrates a washing ball used in FIG. 9.

FIG. 11 illustrates the coupling relationship between the washing balls 520, the rotational shafts 521, the support protrusions 530, and the holding sills in more detail. Referring to FIG. 1, the holding sills 531 are at ends of pairs of support protrusions 530. As shown, the rotational shaft 521 is located in the holding sills 531 (such as by pressing the rotation shaft to force the holding sills 531 apart) such that the washing balls 520 can rotate.

Figure 12A:
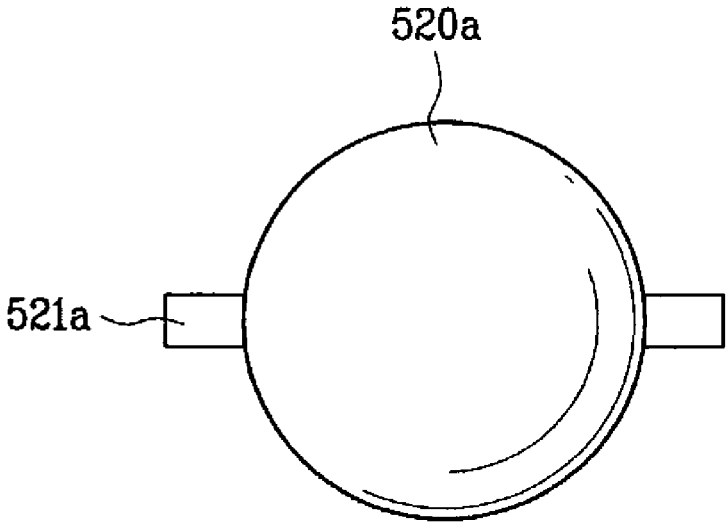
FIG. 12A and FIG. 12B illustrate alternative washing balls used in FIG. 9.
Figure 12B:
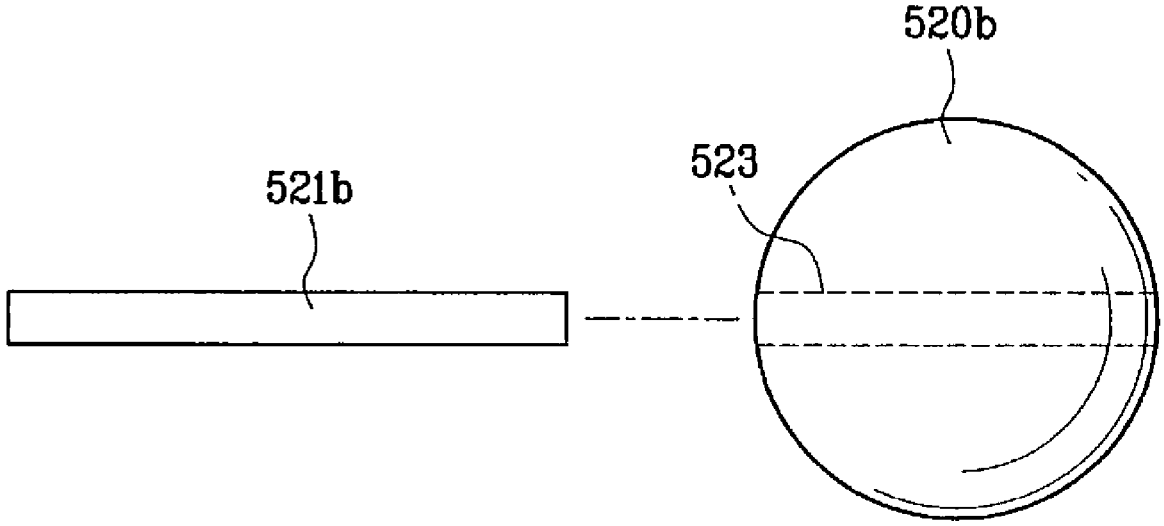

FIG. 12A and FIG. 12B illustrate washing balls 520*a* and 520*b* that are suitable for use in the structure of FIG. 9. Referring to FIG. 12A, rotational shafts 521*a* extend from a washing ball 520*a* so as to define a centerline of the washing ball 520*a*. Referring to FIG. 12B, alternatively, a rotational shaft 521*b* passes through a penetrating hole 523 through the center of a washing ball 520*b*.

Referring once again to FIG. 9, the lifter body 510 further includes a curved surface 511 that directs laundry to the center of the drum. A friction part 512 increases the coupling adherence of the lifter 500 to the drum. A locking part 513 provides the actual coupling force.

The curved surface 511 forms a protruding face having the washing ball insertion holes 515. The protruding height of the curved part 511 increases from the front to the rear of the lifter 500. The lifter body 510 tends to move laundry toward the center of the drum, thereby improving washing performance.

The friction part 512 also has a curved surface, thereby enabling the lifter body 510 to adhere more closely with the drum. The locking part 513 is located at a concave portion at the rear of the lifter body 510. A bracket 541 and a finishing member 542 are inserted, in order, into the concave portion. A locking bolt 543 penetrates the drum, finishing member 542, and bracket 541 such that the lifter body 510 is fastened to the drum.

Figure 13:
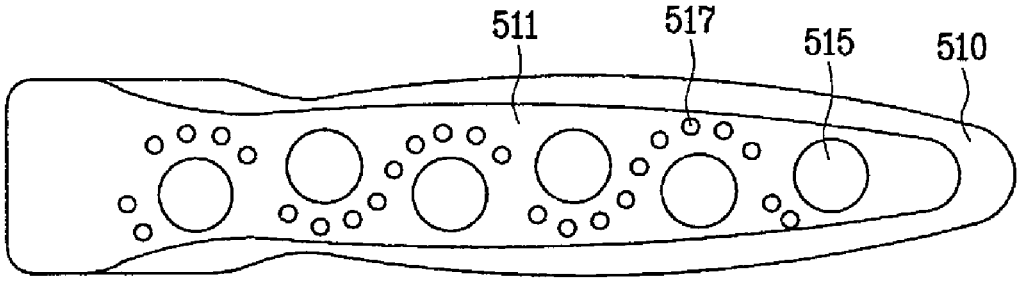
FIG. 13 illustrates a lifter body used in FIG. 9.

FIG. 13 illustrates a specific configuration of a lifter body 511 that is suitable for use in the lifter of FIG. 9. As shown, the lifter body 510 has convex portions along a streamlined, elongated shape. Additionally, the lifter body 510 is gradually tapered from the bottom to the curved surface part 511. This reduces drag with the washing water. Furthermore, a plurality of drain holes 517 is formed through the curved surface 511. The drain holes 517 enable the wash water to freely flow between the lifter 500 and the drum, thereby improving the washing performance more greatly.

Since the functions of the lifter 500 according to the fifth embodiment are the same as for the third embodiment, an explanation of those functions is skipped.

SIXTH EMBODIMENT

Figure 14:
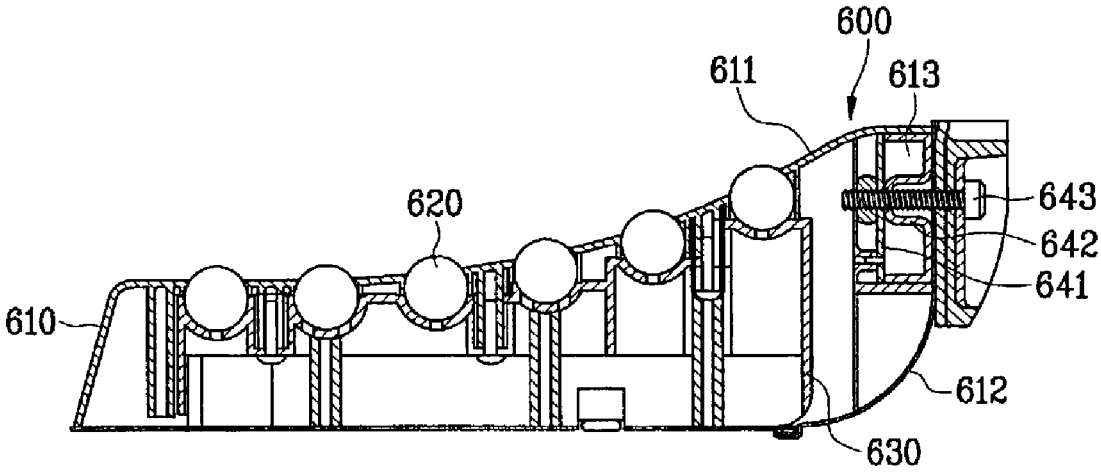
FIG. 14 illustrates a cross-sectional view of a lifter used in a drum type washing machine according to a sixth embodiment of the present invention.

FIG. 14 illustrates a cross-sectional view of a lifter 600 in a drum type washing machine according to a sixth embodiment of the present invention. As the sixth embodiment is similar to the first embodiment (see FIG. 3), a detailed description of only the lifters 600 will be provided. As shown, the lifters 600 include a plurality of washing balls 620 that extend from a protruding face 611. The washing balls 620, which are free to rotate, increase friction between the lifter 600 and laundry.

The lifters 600 are coupled with the wall of drum. The lifters 600 are elongated along a shaft direction. Each lifter includes a lifter body 610 that has a predetermined profile such that the lifter body is higher at the rear that at the front. A ball housing 630 inside the lifter body 610 supports the washing balls 620 such that the washing balls 620 can rotate.

Figure 15:
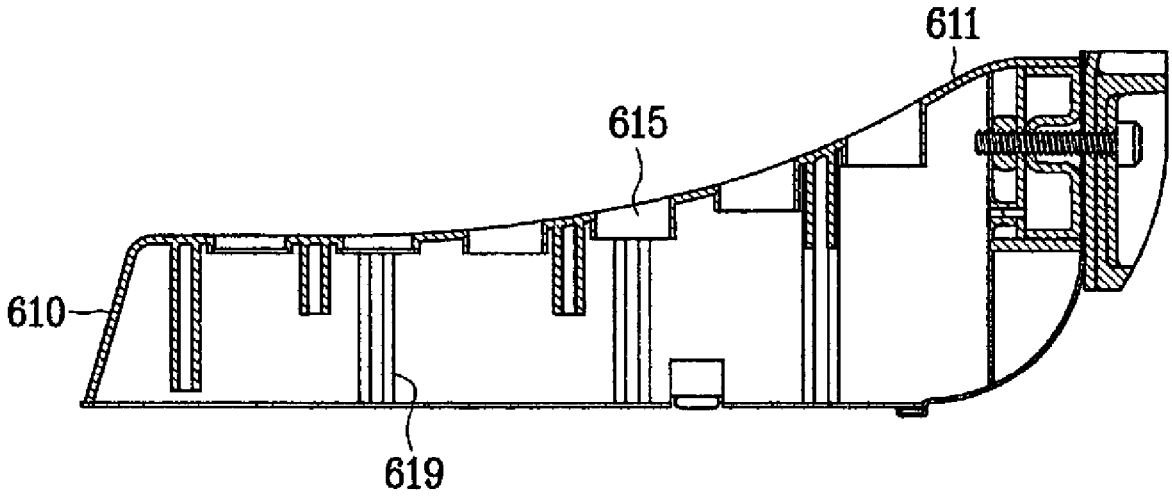
FIG. 15 illustrates views of a lifter body and a ball housing that are used in the lifter of FIG. 14.
Figure 15:
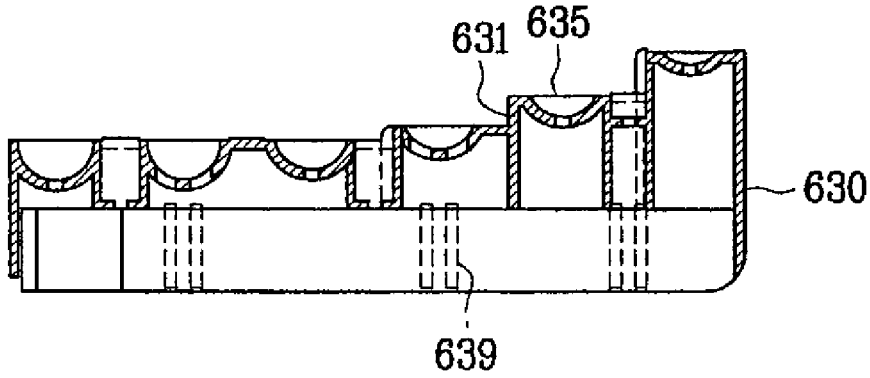

FIG. 15 illustrates a cross-sectional view of a lifter body 610 and a ball housing 630 that are suitable for use in the embodiment of FIG. 14. Referring to FIG. 15, a plurality of washing ball insertion holes 615 are formed along the protruding face 611 of the lifter body 610. The washing ball insertion holes 615 are fabricated such that portions of the washing balls 620 are exposed inside the drum. A plurality of support grooves 635 is formed in an upper face of the ball housing 630 such that the washing balls 620 can rotate. When assembled, the washing ball insertion holes 615 and support grooves 635 are positioned so as to confront each other. The washing balls 620 rotate in a space between the washing ball insertion holes 615 and the support grooves 635.

Referring back to FIG. 14, the lifter body 610 includes a locking portion 613. A bracket 641 and a finishing member 642 are inserted, in order, into the locking portion 613. A locking bolt 643 penetrates the drum, the finishing member 642, and the bracket 641 such that the lifter body 610 is fastened to the drum.

The lifter body 611 has a streamlined shape similar to that of the lifter body 510 (see above) and thus includes convex portions along its length. However, the washing ball insertion holes 615 differ in height such that the ones in the rear are higher than the one in the front. Hence, the ball housing 631 is preferably formed with steps.

Figure 16:
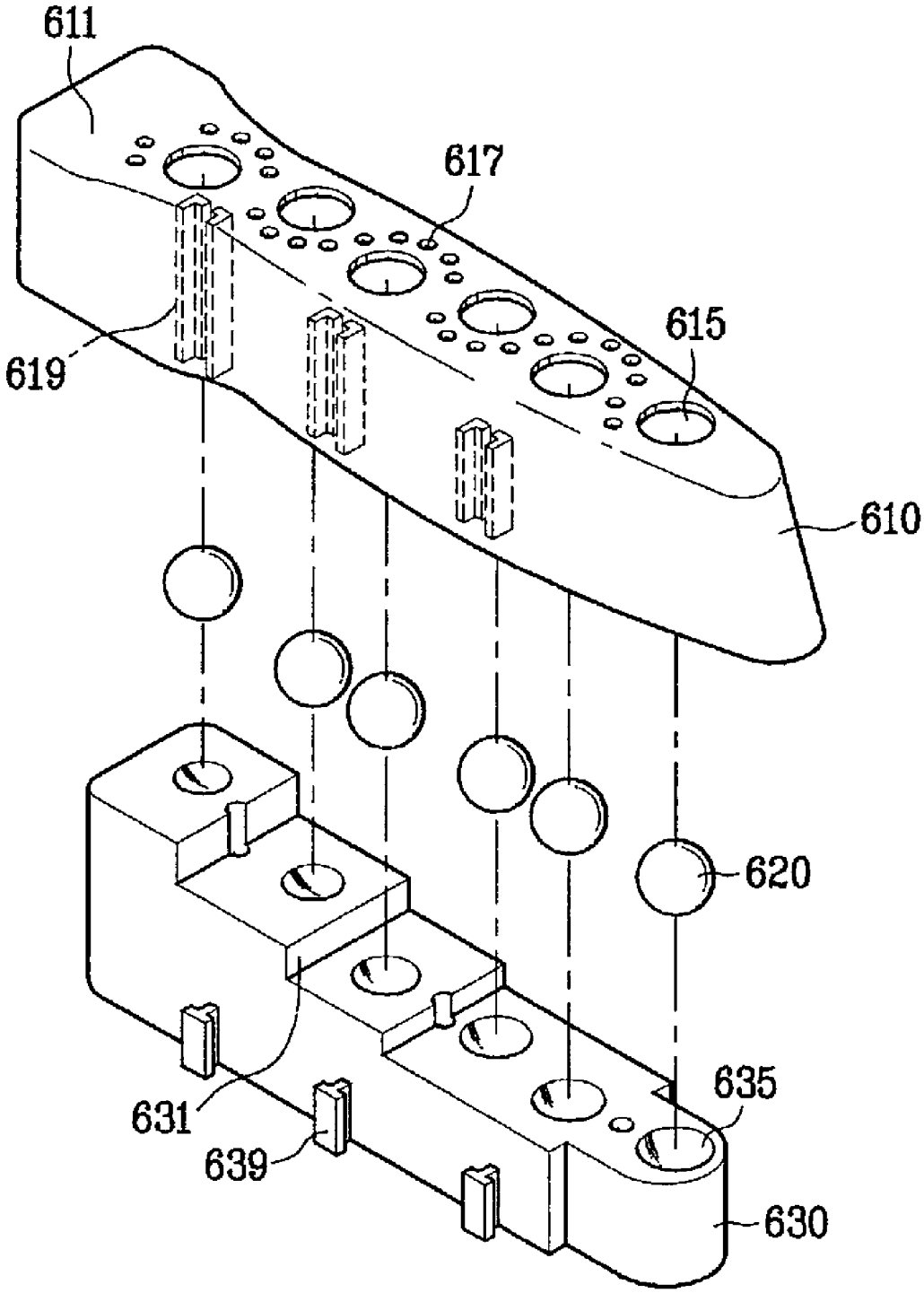
FIG. 16 illustrates a disassembled lifter used in FIG. 14.

FIG. 16 shows how a ball housing 630 is coupled with the lifter body 610 using a fit system such that the washing balls 620 are disposed between the lifter body 610 and the ball housing 630. Referring to FIG. 16, a plurality of locking slots 619 is formed in a coupling face of the lifter body 610, and a corresponding plurality of locking protrusions 639 are formed at a coupling face of the ball housing 630. Specifically, the locking slots 619 and locking protrusions 639 are vertically formed with matching rectangular cross-sections. The locking slots 619 are relieved to receive ribs that retain the locking protrusions 639 to the ball housing 630 (the ribs have 'T'-cross-sections). Therefore, when the ball housing 630 is mated inside the lifter body 610, the locking protrusions 639 slide into the locking slots 619 so as to fix the ball housing 630 to the lifter body 639.

Figure 17:
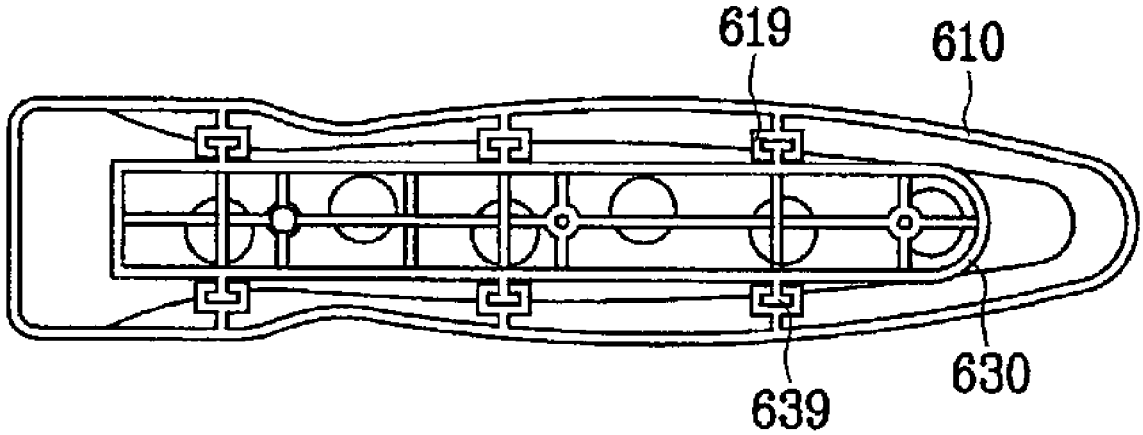
FIG. 17 illustrates a bottom view of a lifter used in FIG. 14.

FIG. 17 illustrates a bottom view of a lifter 600 according to FIG. 14. In particular, FIG. 17 shows the fit between the locking slots and protrusions 619 and 639.

Referring now to FIG. 16, the lifter body 610 includes a plurality of drain holes 617 through the curved surface 611. The drain holes 617 have the same function as the previously described drain holes.

The operation of the lifter 600 in a washing machine according to the sixth embodiment is similar to that of the third embodiment. Therefore, a detailed description will not be specifically provided.

Accordingly, the present invention has various advantages. For example, the friction enhancers, such as washing protrusions and washing balls, improve laundry friction, thereby improving washing performance. Additionally, the friction enhancers reduce adherence of laundry to the lifters, thereby reducing the difficulty of removing laundry. Furthermore, by varying the protruding height of the lifters in slant-drum washing machine the tendency of laundry to congregate at the rear of the drum is reduced, thus enabling a more even distribution of laundry in the drum, which improves washing performance and which reduces the difficulty of removing laundry.

It will be apparent to those skilled in the art than various modifications and variations can be made in the present invention. Thus, it is intended that the present invention covers the modifications and variations of this invention provided they come within the scope of the appended claims and their equivalents.

What is claimed is:

1. A washing machine comprising:
a cabinet;
a tub inside the cabinet for retaining wash water;
a drum inside the tub for holding and selectively moving laundry;
a friction member mounted on the inside of the drum for generating a water current in response to drum movement, and
friction enhancers rotatably supported within the friction member and protruding from the friction member into the drum;
wherein the friction member contacts laundry when the drum moves such that a friction force is established between the friction member and the laundry; and
wherein the friction enhancers increase the friction force between the friction member and the laundry.

2. The washing machine of claim 1, wherein the friction enhancers include a washing ball.

3. The washing machine of claim 2, wherein the washing ball rotates.

4. The washing machine of claim 3, wherein the tub is slanted such that the front is higher than the rear.

5. The washing machine of claim 4, wherein the lifter increases in height from the front to the rear.

6. The washing machine of claim 5, wherein the friction enhancers include washing protrusions that protrude into the drum.

7. The washing machine of claim 5, wherein the friction enhancers include a plurality of washing balls that rotate by laundry friction.

8. The washing machine of claim 1, wherein the friction enhancers are hemispherical.

9. The washing machine of claim 1, wherein the friction enhancers include a plurality of drain holes.

10. The washing machine of claim 1, wherein the friction member is a lifter.

11. The washing machine of claim 10, wherein the lifter includes a plurality of drain holes.

12. The washing machine of claim 10, wherein the lifter includes:
a lifter body coupled with the drum and having washing ball insertion holes for retaining washing balls partially within the lifter; and
a ball support within the lifter body for supporting washing balls such that the washing balls can rotate.

13. The washing machine of claim 12, wherein a diameter of each washing ball is greater than a diameter of the washing ball insertion holes.

14. The washing machine of claim 13, wherein a washing ball includes an auxiliary protrusion.

15. The washing machine of claim 12, wherein the ball support is coupled to the lifter body.

16. The washing machine of claim 12, wherein the ball support includes a support cover having a plurality of support recesses for supporting washing balls.

17. The washing machine of claim 12, wherein the ball support includes support protrusions inside the lifter body and adjacent the washing ball insertion holes, wherein the support protrusions support the washing balls.

18. The washing machine of claim 17, wherein a washing ball is located between pairs of support protrusions.

19. The washing machine of claim 18, wherein a holding sill is formed by ends of a pair of support protrusions.

20. The washing machine of claim 19, wherein a washing ball is supported by a rotational shaft, and wherein the rotational shaft is supported by the holding sill.

21. The washing machine of claim 20, wherein the rotational shaft penetrates through a washing ball.

22. The washing machine of claim 20, wherein the rotational shaft extends from a washing ball.

23. The washing machine of claim 12, wherein the ball support includes a ball housing within the lifter body, wherein the ball housing includes support recesses that support washing balls.

24. The washing machine of claim 23, wherein locking slots are formed at a coupling face of the lifter body, wherein matching locking protrusions are formed at a coupling face of the ball housing, and wherein the locking slots and the locking protrusions are mated.

25. The washing machine of claim 24, wherein the locking slots have rectangle cross-sections and wherein the locking protrusions have a 'T' cross-section.

26. The washing machine of claim 23, wherein the ball housing has a stepped shape.

27. The washing machine of claim 12, further including a plurality of drain holes through the lifter.

28. The washing machine of claim 12, wherein the lifter body has a streamlined shape with convex portions.

29. The washing machine of claim 12, wherein the lifter body comprises:

a curved surface having washing ball insertion holes, wherein the curved surface has a greater height toward a rear of the drum;

a friction part having a curved surface that follows the contour of a rear corner of the drum; and a locking part for retaining the lifter body to the drum.

30. The washing machine of claim 29, wherein a bracket and a finishing member are inserted into the locking part, and wherein a fastener couples the finishing member and the bracket to the drum such that the lifter is coupled to the drum.

31. The washing machine of claim 1, further including a drive member for moving the drum.

32. The washing machine of claim 31, further including a drive shaft coupling the drive member to the drum.

33. The washing machine of claim 31, wherein the drum rotates along a horizontal axis.

34. A washing machine, comprising:

a cabinet;

a vessel inside the cabinet holding and selectively moving laundry;

a motor for moving the vessel;

a friction member mounted on the inside of the vessel for generating a water current in response to vessel movement, and friction enhancers rotatably supported within the frictional member and protruding from the friction member into the vessel;

wherein the frictional member contacts laundry when the vessel moves such that a friction force is established between the friction member and the laundry; and wherein the friction enhancers increase the friction force between the friction member and the laundry.

35. The washing machine of claim 34, wherein the friction member is a lifter.

36. The washing machine of claim 35, wherein the friction enhancers include a rotating washing ball.

37. The washing machine of claim 36, wherein the friction enhancers include a plurality of drain holes.

38. The washing machine of claim 36, wherein the lifter includes a plurality of drain holes.

39. The washing machine of claim 34, wherein the friction member is a pulsator.

40. The washing machine of claim 39, wherein the friction enhancers include a rotating washing ball.

* * * * *